United States Patent [19]

van de Pol

[11] Patent Number: 4,664,957

[45] Date of Patent: May 12, 1987

[54] FLEXIBLE SACK FOR CARRYING BULK MATERIALS

[75] Inventor: Gustaaf M. W. van de Pol, Zevenaar, Netherlands

[73] Assignee: Akzo nv, Arnhem, Netherlands

[21] Appl. No.: 751,377

[22] Filed: Jul. 3, 1985

[30] Foreign Application Priority Data

Apr. 17, 1985 [NL] Netherlands ..... 8501121

[51] Int. Cl.[4] ..... B65D 33/02

[52] U.S. Cl. ..... 428/35; 383/6; 383/17

[58] Field of Search ..... 428/35, 257; 383/17, 383/6; 248/95

[56] References Cited

U.S. PATENT DOCUMENTS

| | | | |
|---|---|---|---|
| 4,220,684 | 9/1980 | Olson | 428/35 |
| 4,276,330 | 6/1981 | Stanley et al. | 428/35 |
| 4,307,764 | 12/1981 | Nattrass | 383/17 |

*Primary Examiner*—John L. Goodrow

*Attorney, Agent, or Firm*—Stevens, Davis, Miller & Mosher

[57] ABSTRACT

Flexible (single use) sack for transporting goods, such as bulk goods, having a weight of at least 3000 N. It comprises a fabric woven from polypropylene tapes and/or threads and exhibits a mean strip breaking strength of at least 550 N per 50 mm. Sacks with an improved safe working load which can be more readily handled, are obtained by using tapes or threads comprising a matrix of 75–85% B.W. of polypropylene and 25–15% B.W. of polyester, preferably polyethylene terephthalate. The polyester is preferably present in the form of fibrils.

7 Claims, 1 Drawing Figure

FLEXIBLE SACK FOR CARRYING BULK MATERIALS

Figure 1:
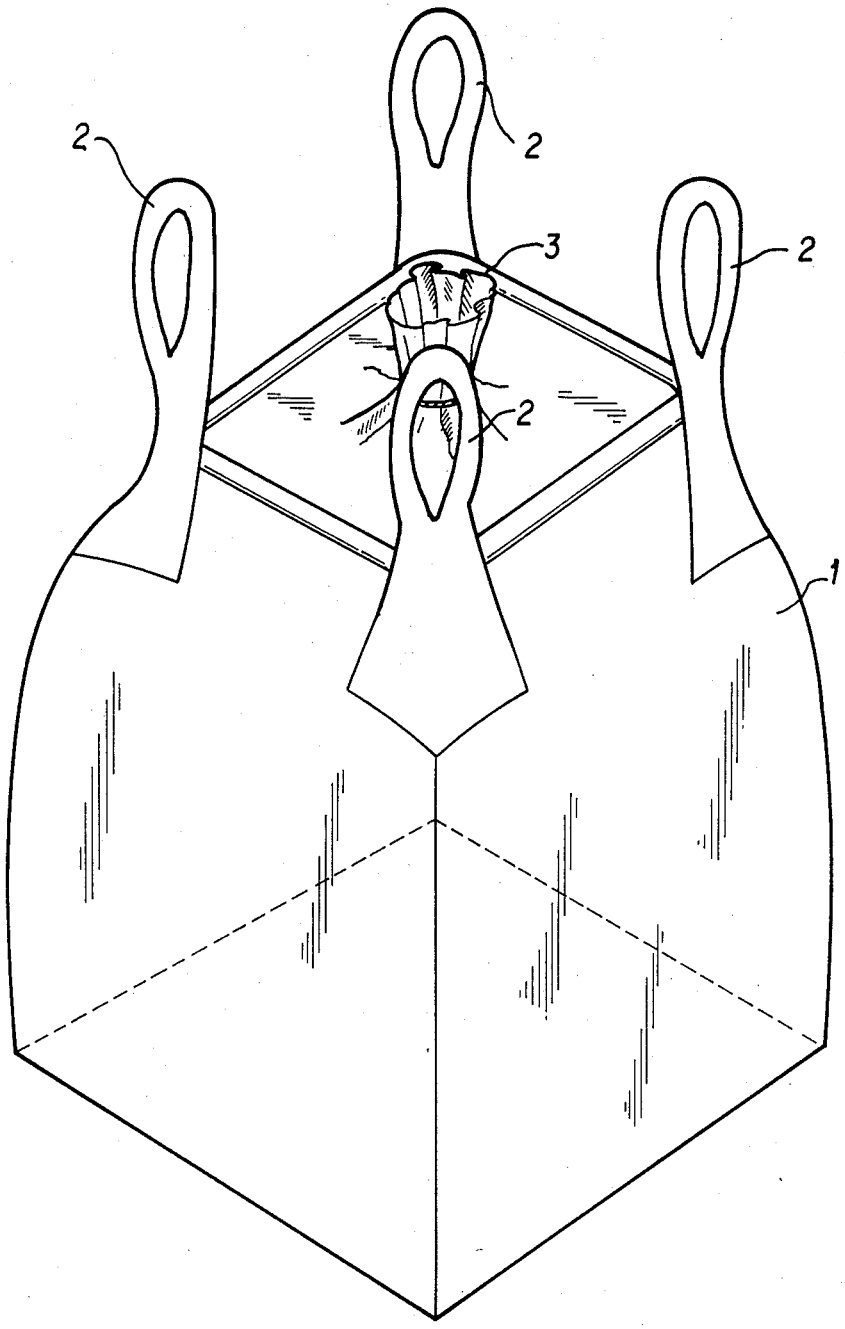

The invention relates to a large flexible sack for transporting materials, such as bulk materials, weighing at least 3000 N and having a volume of at least 0.3 $m^3$, the sack being substantially formed of a woven fabric of polypropylene tapes and/or threads, the fabric strength in the direction of the warp and/or weft being at least 550 N/50 mm, and the polypropylene may be provided with an additive.

Large sacks of this kind are known from inter alia British Standards Institution specification BS 6162: 1981.

These flexible sacks or containers are in practice applied on a large scale as disposable bags for non-recurring use for transporting and storing various kinds of materials in bulk such as grain, cement, artificial manure, fodder and like substances.

The large sacks used hitherto are commercially available in various dimensions for containing volumes of, e.g., 0.5 to 1.5 $m^3$. The commercially available large sacks also differ with regard to the loads to be transported. In particular, the large sacks hitherto are generally used for loads of e.g. 5000 N, 10,000 N, 12,500 N and 15,000 N. These loads are generally indicated on the sack and form the "SWL" (safe working load) value, i.e. the load which may safely be carried. The SWL value is always one fifth of the breaking strength since a safety factor of 5 is observed for these loads. Although good results are achieved with the known large disposable bags, the maximum fabric strength for polypropylene tapes is 260 grams/$m^2$ in view of efficient manufacture. This limits the magnitude of the SWL value to be applied to known sacks of polypropylene. The weight, further, of the known large sacks when empty, and especially of a large number of empty sacks, is still quite appreciable. Furthermore, the known sacks are not always easy to handle during manufacture, storage and transport. The invention has for its object to provide especially for non-recurring use a large sack of the type indicated in the opening paragraph which does not display the disadvantages mentioned above.

The sack according to the invention is characterised in that the fabric is wholly or partially built up of tapes or threads, the material of each of the tapes or threads chiefly being formed of a matrix of polypropylene incorporating a polyester, especially polyethylene terephthalates, and in that the matrix is used in an amount of 75 to 85 percent by weight, and preferably approx. 80 percent by weight, based on the total weight of the tapes or threads, and polyester, which is largely present in the form of fibrils, is used in an amount of approx. 20% by weight, based on the total weight of the tapes or threads. An especially favourable embodiment of the sack according to the invention is characterised in that the mean fabric strength in the direction of the warp and/or weft of the fabric is 2500 to 8000 N/50 mm, the fabric having a weight of 100 to 400 grams/$m^2$, and preferably approx. 200 to 280 grams/$m^2$ and the elongation at break in the direction of the warp and/or weft of the fabric is 5% to 25%, preferably approx. 9 to 18%. A preferred embodiment of the sack according to the invention is characterised in that the fabric, especially with a plain weave or a weave derived therefrom, contains 4 to 8 tapes per cm in the direction of both warp and weft, and preferably approx. 5 to 6 tapes per cm, and in that the fabric is formed of tapes each of which has a linear density of decitex 1500 to 2000 and preferably approx. decitex 2200. Optinally, other weaves can be applied for the fabric.

It has surprisingly been found that the sack according to the invention can be applied particularly favourably and economically in this sector of large flexible sacks for single use. The sack according to the invention is suited for heavier loads, especially those with an SWL value of 20,000 N while maintaining the said safety factor of 5. It is thought conceivable that a yet higher SWL value of e.g. 30,000 N may eventually be attainable with the sack according to the invention.

Compared with the high SWL value of 15,000 N usual up to now with the conventional single-use sacks consisting entirely of polypropylene, this means an increase in the SWL value of 25%. An increase of the weight to be carried per sacks leads, in particular, to appreciable economy as far as filling, emptying, storage, loading and transporting are concerned. Moreover, the sacks according to the invention with a greater SWL value are particularly economical in that they lead to a reduction in the inevitable losses inherent in non-recurring use, a larger sack being cheaper than a smaller one.

However, the sack according to the invention is not only of advantage for carrying heavy loads, i.e. in the range of the higher SWL values. The sack according to the invention may advantageously be also used for lower SWL values, i.e. SWL values lower than 15,000 N. The empty sack according to the invention has a lower weight than the conventional sack with the same SWL value within the range of SWL values of 5000 to 15,000 N for disposable bags for light to moderately large loads. This is largely possible because the sack according to the invention can be produced from lighter fabrics, especially a fabric weight of 150–200 grams/$m^2$. In addition to the advantage of lower transporting costs, for both empty and full sacks, the lighter sacks according to the invention have the advantage at the same SWL value that they are less difficult to handle during manufacture, storage and filling. In addition, with traditional sacks consisting entirely or polypropylene there is the problem of UV-resistance. In fact, the polypropylene polymer may degrade under the influence of UV light during storage or transport in the open of full or empty bags. As stated in Appendix D3, paragraph 3, of the British Standards Insitution specification BS 6162: 1981 already mentioned, the resistance of the known sacks to degradation by UV light may be improved by suitable additives. Suitable additives are relatively expensive and are commercially available under the designation "HALS" (Hindered Amine Light Stabilizers) and are added to the polypropylene in a small amount of, e.g., 0.25–1% by weight. It has been found that without the addition of the usual UV stabilizers the sack according to the invention is virtually as resistant to UV light as the UV stabilized sack consisting entirely of polypropylene.

The favourable properties of the disposable sack according to the invention will be explained further in the following examples, the data and the measuring results being summarised in the table below.

| Properties of the fabric of the sack | Conventional sack of type A | Conventional sack of type B | Sack according to the invention |
|---|---|---|---|
| Weight (g/$m^2$) | 242 | 264 | 250 |

-continued

| Properties of the fabric of the sack | Conventional sack of type A | Conventional sack of type B | Sack according to the invention |
|---|---|---|---|
| Weave | plain | plain | plain |
| Warp | | | |
| Titre (dtex) | 2300 | 2280 | 2200 |
| Density (number of threads/cm) | 5,6 | 5,1 | 5,8 |
| Fabric strength (N/50 mm) | 2800 | 2450 | 4200 |
| Elongation at break (%) | 10 | 13 | 16 |
| Weft | | | |
| Titre (dtex) | 2300 | 2440 | 2200 |
| Density (number of threads/cm) | 5 | 5,5 | 5 |
| Fabric strength (N/50 mm) | 2600 | 2315 | 3500 |
| Elongation at break (%) | 6 | 9 | 11 |

In the table the properties of the sack according to the invention are compared with two known commercially available sacks of the conventional type supplied by the manufacturers A and B. Mention is made of the properties of the fabric of the known sacks A and B and of the sack according to the invention. The known sacks A and B and the sack according to the invention were made from a tape yarn in the usual way.

The tapes used in the fabrics of the known sacks of types A and B consisted entirely of polypropylene. The tapes used in the fabric of the sack according to the invention consisted of approx. 80% by weight of polypropylene and 20% by weight of polyethylene terephthalate.

The table shows, in particular, that the fabric of the sack according to the invention possesses an appreciably higher fabric strength at about the same weight (250 g/m$^2$) in the direction of both warp and weft, namely of 4200 and 3500 N/50 mm, respectively. The fabric strengths in these examples of the fabric of the sack according to the invention are in the direction of both warp and weft respectively about 1.60 to 1.40 times higher on average than in known sacks of types A and B. The tables also show that the elongation at break of the sack according to the invention is also appreciably higher, which is an advantage in view of the repetitive load occurring when hoisting the sacks during filling and emptying.

The sacks according to the invention, of which the data are indicated in the table, are suited for a maximum carried weight of 20,000 newton i.e. an SWL value of 20,000 N, while maintaining the customary safety factor of 5. The known sacks A and B according to the table are suited only for a maximum carried weight of 15,000 newton i.e. an SWL value of 15,000 N, at the same safety factor of 5.

The sack according to the invention, of which the data are given in the table, is made from tape yarn 80% by weight of which consists of polypropylene of the SAGA type P071S with a melt index of 0.8 and 20% by weight of polyethylene terephthalate type ARNITE A06302 with an intrinsic viscosity of 1.1.

It should be added that the mean fabric strength and elongation at break were measured in accordance with Appendix B of the British Standard Institution specification BS 6162: 1981.

The sack according to the invention is made in the manner usual for known large sacks of this type. Also for the various methods of manufacture and the dimensions of sacks according to the invention and the various requirements to be satisfied by them, the number of seams and the seaming arrangements, reference may be made to the specification BS 6162: 1981.

Like the known sacks, the large disposable sack according to the invention may be equipped in the usual manner with various means known per se for practical use, such as special lifting devices, e.g. in the form of loops, and closing devices at the top and/or bottom. The sack according to the invention may also be provided with a coating and optionally an impermeable liner of thin plastic film, e.g. of polyethylene, may be inserted.

An embodiment of the sack according to the invention is illustrated in the accompanying schematic drawing. The entire sack is illustrated in perspective in the filled state. The sack 1 is equipped with four loops 2, and the sack is closed at its top 3. The sack according to the invention may be opened by cutting it open at the bottom. The invention is of course not restricted to the sack of the type shown in the drawing. Virtually all embodiments known per se for the large disposable sacks of this type can also be applied to the sack according to the invention.

As regards the state of the art, it should be added that tapes of 80% by weight of polypropylene and 20% by weight of polyethylene terephthalate from which the fabric of the sack according to the invention is made are known per se from GB 1 559 056.

In addition to the essential components according to the invention, namely the matrix of polypropylene with the polyethylene terephthalate fibrils distributed therein, the tapes from which the fabric for the sack according to the invention is made may contain other additives, such as a small quantity of polyethylene. The addition of polyethylene generally improves the extrusion of the tapes and produces tapes with a smoother and a more homogeneous surface which less readily fray, which may have a favourable effect on the strength of these tapes and consequently on the strength of the sacks woven from them.

The fabric for the sack according to the invention is made from so-called slit film yarn, also known as tape yarn. The tapes to be used may optionally be prefibrilled.

Within the scope of the invention various modifications may be made.

I claim:

1. Flexible sack for carrying substances, such as bulk materials with a weight of at least 3000 N, the sack being substantially formed of a woven fabric of polypropylene tapes and/or threads, the fabric having a mean strength of at least 550 N/50 mm in warp and/or weft direction, the polypropylene being provided with an additive, characterized in that the fabric is wholly or partly built up of tapes and/or threads substantially formed of a matrix of polypropylene incorporating a polyester, preferably polyethylene terephthalate, and in that the matrix is used in an amount of 75–85% by weight, based on the total weight of the tapes or thread, and the polyester in an amount of 25–15% by weight, based on the total weight of the tapes or threads, and in that the mean fabric strength in the warp and/or weft direction is 2500 to 8000 N/50 mm and the fabric weights are 100 to 400 grams/m$^2$, preferably approximately 200 to 280 grams/m$^2$.

2. Sack according to claim 1, characterised in that the matrix of polypropylene forms approx. 80% by weight of the total weight of the tapes, and the polyester approx. 20% by weight of the total weight of the tapes.

3. Sack according to claim 1, characterised in that the polyester is present in the matrix of polypropylene in the form of a large number of fibrils.

4. Sack according to claim 1, characterised in that the sack is so constructed that an SWL value not exceeding 30,000 N may be applied.

5. Sack according to claim 1, characterised in that the elongation at break in the direction of the warp and/or the weft of the fabric is 5% to 25%, and preferably approx. 9 to 18%.

6. Sack according to claim 1, characterised in that the fabric contains 4 to 8 tapes per cm, and preferably approx. 5 to 6 tapes per cm, in the direction of both warp and weft.

7. Sack according to claim 1, characterised in that both the weft and/or the warp of the fabric is formed of tapes each having a linear density of decitex 1500 to 2500 decitex, preferably approximately decitex 2200.

* * * * *